US009677290B2

(12) United States Patent
Berger et al.

(10) Patent No.: US 9,677,290 B2
(45) Date of Patent: Jun. 13, 2017

(54) ATTACHABLE ANCHORING SYSTEM FOR WALL FORMWORK, AND METHOD

(71) Applicant: Hunnebeck GmbH, Ratingen (DE)

(72) Inventors: Martin Berger, Nettetal (DE); Volker Klehr, Viersen (DE); Klaus Hagemes, Viersen (DE)

(73) Assignee: Hünnebeck GmbH, Ratingen (DE)

( * ) Notice: Subject to any disclaimer, the term of this patent is extended or adjusted under 35 U.S.C. 154(b) by 0 days.

(21) Appl. No.: 14/415,671

(22) PCT Filed: Feb. 22, 2013

(86) PCT No.: PCT/EP2013/053551
§ 371 (c)(1),
(2) Date: Jan. 19, 2015

(87) PCT Pub. No.: WO2014/012681
PCT Pub. Date: Jan. 23, 2014

(65) Prior Publication Data

US 2015/0167330 A1 Jun. 18, 2015

(30) Foreign Application Priority Data

Jul. 18, 2012 (DE) ..... 10 2012 212 607

(51) Int. Cl.
*E04B 1/00* (2006.01)
*E04G 21/00* (2006.01)
(Continued)

(52) U.S. Cl.
CPC ..... *E04G 17/007* (2013.01); *E04G 17/02* (2013.01); *E04G 17/0652* (2013.01);
(Continued)

(58) Field of Classification Search
CPC ..... E04G 17/02; E04G 17/04; E04G 17/042; E04G 17/045; E04G 17/007;
(Continued)

(56) References Cited

U.S. PATENT DOCUMENTS 3,981,476 A 9/1976 Alexander et al.
4,553,729 A * 11/1985 Connors ..... 249/40
2006/0273481 A1* 12/2006 Peneder ..... E04G 17/0657 264/31
2008/0011698 A1* 1/2008 Simon ..... B60R 9/06 211/85.8
2008/0307735 A1 12/2008 Trimmer
(Continued)

FOREIGN PATENT DOCUMENTS

DE 19 74 244 U 12/1967
DE 36 04 252 A1 8/1987
(Continued)

OTHER PUBLICATIONS

International Search Report for corresponding patent application No. PCT/EP2013/053551 dated Jun. 10, 2013.

*Primary Examiner* — Patrick Maestri
(74) *Attorney, Agent, or Firm* — Renner, Otto, Boisselle & Sklar, LLP

(57) ABSTRACT

The invention relates to an anchoring system for a wall formwork as well as to a method for suspending the anchoring system on the rear side of a wall formwork while dismantling a wall formwork. In order to accelerate a dismantling process, an anchoring system with an anchoring rod (4) and at least one disengageable locking device is provided. The part of the anchoring system that is pulled out of wall formworks after a concrete wall has been produced comprises a suspension means for suspending on a wall formwork the part of the anchoring system that has been pulled out.

8 Claims, 4 Drawing Sheets

Figure 1:
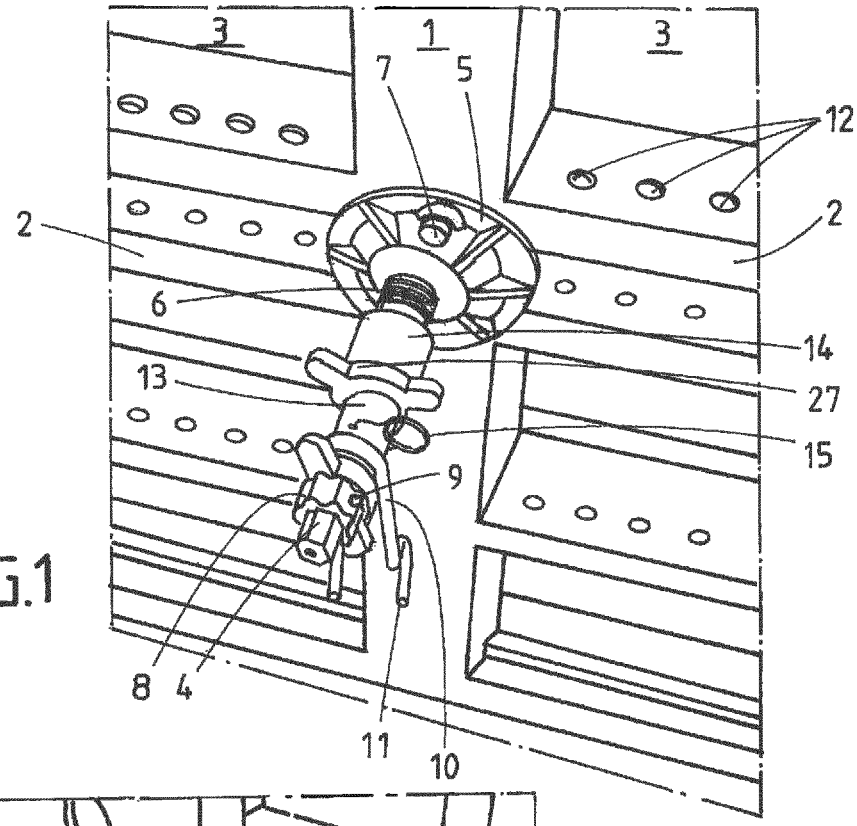

(51) Int. Cl.

| | |
|---|---|
| ***E04G 17/00*** | (2006.01) |
| ***E04G 17/065*** | (2006.01) |
| ***E04G 17/02*** | (2006.01) |
| ***E04G 19/00*** | (2006.01) |
| *E04G 9/02* | (2006.01) |

(52) U.S. Cl.
CPC ..... *E04G 17/0657* (2013.01); *E04G 19/00* (2013.01); *E04G 2009/028* (2013.01); *E04G 2017/008* (2013.01)

(58) Field of Classification Search
CPC ..... E04G 17/0657; E04G 17/0652; E04G 2017/008; E04G 19/00; F16B 39/06; B23P 19/04
See application file for complete search history.

(56) References Cited

U.S. PATENT DOCUMENTS

| | | | | |
|---|---|---|---|---|
| 2012/0286134 | A1* | 11/2012 | Rojas | 249/192 |
| 2013/0019443 | A1 | 1/2013 | Gomes | |

FOREIGN PATENT DOCUMENTS

| | | | |
|---|---|---|---|
| DE | 103 36 414 | A1 | 3/2005 |
| DE | 10 2004 001 091 | A1 | 8/2005 |
| EP | 1 975 337 | A1 | 10/2008 |
| FR | 70 467 | E | 5/1959 |
| GB | 1 029 009 | A | 5/1966 |
| KR | 1020100126002 | | 12/2010 |
| WO | WO 2005/066434 | A1 | 7/2005 |
| WO | 2008/089737 | A1 | 7/2008 |

* cited by examiner

ATTACHABLE ANCHORING SYSTEM FOR WALL FORMWORK, AND METHOD

The invention relates to a method for dismantling and installing a wall formwork as well as to an anchoring system for a wall formwork.

An anchoring system within the sense of the present invention is used in formwork engineering when concreting reinforced concrete structures in order to install wall formworks. A wall formwork comprises a formwork facing on the front and elements supporting the formwork facing on the back, such as longitudinal beams, crossbars and frames. In the erected state of a wall formwork, a longitudinal beam extends in the vertical direction and a crossbar in the horizontal direction.

The two sides of a wall to be concreted are delimited by wall formworks. With its formwork facing, the front of each wall formwork in that case adjoins the concrete. Wall formworks facing each other are generally retained by a plurality of anchoring systems. The anchoring rods are pushed through openings in the wall formworks and attached at their ends by means of locking devices to the elements supporting the respective formwork facing in such a way that at least the tensile force acting upon the anchoring rods during concreting is absorbed. These openings that pass through the wall formworks are hereinafter referred to as anchoring rod bores.

Formwork engineering differentiates between a holding formwork and a closing formwork. A holding formwork is a wall formwork which is erected first. Subsequent thereto, the closing formwork is erected opposite from the holding formwork. Concrete is poured into the intermediate space between the holding formwork and the closing formwork. The hardening of the concrete creates a wall.

Usually, one or both ends of an anchoring rod comprise a threaded portion onto which nuts are screwed as anchor fixing members. The middle region of such an anchoring rod, to which concrete can adjoin during concreting, advantageously either has a smooth surface or is enveloped at least during concreting by a sleeve having a smooth surface. Otherwise, threaded portions of an anchoring rod would be covered in concrete. In that case, the anchoring rod could no longer be pulled out of the hardened concrete without any trouble.

The maximum effective length of the anchoring rod, and thus the thickness of the wall to be concreted, is therefore determined, as a rule, by the length of the middle anchoring rod region with a smooth surface. At the same time, the pressure exerted by the liquid concrete on the formwork facing during concreting is diverted via the nuts onto the anchoring rods. In the process, the anchoring rods are subjected to tensile stress.

Spacers can be introduced between the formwork facings into the volume of the wall to be concreted, which are able to absorb compression forces arising during concreting, whereby it is ensured that these compression forces do not affect, i.e. reduce, the wall thickness in an undesirable manner. Alternatively or additionally, the locking devices can be attached to the wall formworks so that they are also able to absorb compression forces.

If the concrete that has been poured between two wall formworks has hardened, the anchoring rod is disengaged from a locking device and pulled out of the concrete wall. If necessary, the top side of a closing formwork is suspended from a hook of a crane prior to this, so that it does not fall over once all anchoring rods have been pulled out. Finally, the wall formworks are shifted in a suitable manner, for example by means of the crane, in order to produce a next wall or a next wall portion. If the wall formworks have been shifted, then the anchoring systems are again mounted or attached to the wall formworks.

From the printed publication WO 2008/089737 A1, an anchoring system is known with two locking devices and an anchoring rod for a wall formwork with a first and a second formwork element. On its two ends, the anchoring rod has one threaded portion, respectively, which are screwed into nut members of the locking devices. Each locking device comprises a dome plate that is attached to a rear side of a wall formwork by means of attachment means. Therefore, the anchoring system is capable of absorbing both tensile as well as compression forces of a wall formwork.

The printed publication EP 1975337 A1 relates to a device comprising a frame, a formwork panel and an arm. A housing of the formwork panel holds and guides the arm. The arm 2 can be pivoted back and forth between a folded-in and a folded-out position. An anchoring rod and a tightening nut can be held by a hook of the arm in such a way that two end formworks can thus be clamped to each other. The anchoring rod and the tightening nut are then located in an assembly position and have therefore not been suspended on the fork of the arm within the context of a dismantling process. The fork of the arm therefore serves as an anchoring rod bore, and thus for holding two opposite wall formworks, and not for holding a part of an anchoring system to a wall formwork subsequent to a dismantling process.

Printed publication DE 10336414 A1 discloses a screw bracket of an anchoring system. Printed publication DE 1974244 U discloses a bent pulling handle of an anchoring system. Neither printed publication teaches to dimension the screw bracket or the pulling handle in such a way that it enables an attachment of a part of the anchoring system to an associated wall formwork within the context of a formwork being dismantled.

The above-mentioned features known from the prior art can be combined, individually or in any combination, with the subject matter of the invention described below.

It is the object of the invention to simplify the dismantling and the assembly of a wall formwork and to develop an anchoring system for this purpose.

The object of the invention is accomplished by a method having the features of the first claim and by an anchoring system having the features of the co-ordinated claim. Advantageous embodiments are apparent from the dependent claims.

In order to accomplish the object, an anchoring system with an anchoring rod and at least one disengageable locking device is provided. The part of the anchoring system or of the anchoring set that is pulled out of wall formworks after a concrete wall has been produced comprises a suspension means for suspending on a wall formwork the part of the anchoring system that has been pulled out. A suspension means is a component that enables a pulled-out part of an anchoring system to be suspended on a wall formwork.

A different attachment member may also be provided instead of a suspension means. A magnet, for example, may serve as an attachment member. In that case, the magnet, in particular, is a part of the anchoring system in order to be able to attach the part that can be pulled out in an arbitrary location on a supporting element that consists of a suitable metal. Screwing or plug-in/clip connections are also possible.

The part of an anchoring system pulled out for dismantling a wall formwork basically comprises, in addition to the anchoring rod, a locking device. In the mounted state, this locking device rests against the rear side of a wall formwork in order to absorb forces, and preferably against the rear side of a closing formwork in order to optimize a dismantling process. In an advantageous embodiment, the locking device can be attached to the rear side of the wall formwork, for example by means of a screw, so that the anchoring system is capable of absorbing both compression forces as well as tensile forces. The locking device can be firmly connected to the anchoring rod. Advantageously, however, it is disengageably connected to the anchoring rod, particularly by means of a nut, in order to be able to optimize effective lengths of the anchoring rod.

After an anchoring rod has been pulled out, the pulled-out part of the anchoring system can be suspended on the wall formwork. If the wall formwork with the suspended part of the anchoring system is shifted in order to produce another wall or another wall portion, the suspended part of the anchoring system is immediately ready to hand for a subsequent assembly process, which, advantageously, reduces the time spent for the assembly. As a rule, there is a plurality of such parts of an anchoring system that are suspended on a wall formwork, particularly on a closing formwork, subsequent to this wall formwork being dismantled. The pulled-out part of an anchoring system is preferably suspended adjacent to the anchoring rod bore from which the part of the anchoring system has been previously pulled out. Advantageously, a technician in that case does not have to leave his position in order to suspend the pulled-out part of the anchoring system on the rear side of the wall form work subsequent to pulling it out, or to grasp the pulled-out part and then push the anchoring rod into the anchoring rod bore within the context of a subsequent assembly.

Alternatively or additionally, the anchoring system comprises a locking device that can be attached to a rear side of a wall formwork, and particularly on the rear side of a holding formwork, particularly by means of a screw, a latching connection or a bayonet connection. This locking device is configured in such a way that the part of the anchoring system provided for being pulled out can be attached to this locking device, namely when the latter is attached to the rear side of a wall formwork at the same time. In this embodiment, a hole or a bore in the locking device, which, within the context of a dismantling process, is generally not supposed to be detached from the wall formwork into which the anchoring rod of the anchoring system can be inserted, is sufficient in a particularly simple and reliable embodiment in order to attach to this locking device the part of the anchoring system provided for being pulled out. The part of the anchoring system that is supposed to be pulled out of a formwork within the context of a dismantling process therefore requires no attachment member with any special configuration in order to attach to the locking device, and thus also to the rear side of a wall formwork, the part provided for being pulled out in order to dismantle a formwork.

In a particularly simple embodiment of the invention, the part of the anchoring system that is finally pulled out again from a wall formwork comprises a hook that can be suspended on a hole in a supporting element of a wall formwork. In this embodiment, already existent holes in supporting elements of a wall formwork can be used for suspension. Already existing wall formworks need not be refitted in order to be able to suspend an above-mentioned part of an anchoring system.

In one embodiment, a wall formwork has on its rear side a suspension means in the form of, for example, one or two hooks on which an anchoring rod can be suspended. At the same time, such hooks are preferably configured as spacers in order to provide a distance between wall formworks that are disposed horizontally one above the other.

As a rule, supporting elements of a wall formwork are formed by hollow profiles, such as a rectangular profile or a hat-shaped profile. Such profiles, which usually consist of metal, generally have a plurality of lateral holes or bores, i.e. in walls of the profiles that include a right angle with the front of the wall formwork, i.e. the formwork facing. A pulled-out part of an anchoring system is suspended, in particular, from such holes, preferably from an upper hole of a longitudinal beam, which extends in the horizontal direction in the erected state of a plank partition.

In one embodiment, the suspension means, which comprises a simple hook, for example, is attached to a locking device. A locking device protrudes laterally with respect to the outer circumference of the anchoring rod. This protruding towards the side can be used for providing the hook at a particularly suitable location.

In one embodiment of the invention, the locking device comprises at least one wing that protrudes laterally from the anchoring rod, for example a wing of a wing nut. Advantageously, a wing nut can be screwed tight and loosened without the use of tools. The suspension means, which in particular comprises a hook, is preferably attached to such a wing in order to be able to attach the suspension means at an advantageous position.

In one embodiment of the invention, one end of the anchoring rod is provided with at least one wing which preferably includes a right angle with the anchoring rod. Preferably, there are two such protruding wings, which preferably include amongst each other an angle of 180° and are preferably of the same length and/or have the same shape. These one or more wings are connected to the end of the anchoring rod in such a way that they can be used as a handle and lever for rotating the anchoring rod. If required, the anchoring rod can be screwed, for example manually, into a threaded portion of a locking device attached to the rear side of a wall formwork, in particular of a closing formwork.

In order to provide the end of the anchoring rod with one or more wings, the latter can for instance be connected by substance-to-substance connection to the end of the anchoring rod, for example welded thereto. The end of the anchoring rod can be provided with one or more wings by a wing nut being screwed onto the end and the wing nut being fixated at a suitable location by a grooved pin, for example. In one embodiment, such a grooved pin leads from a bore in the nut into a bore of the anchoring rod in order thus to fixate the position of the wing nut. The latter can then no longer be rotated relative to the anchoring rod. The grooved pin is preferably secured against falling out of its fixating position by substance-to-substance, frictional and/or positive connection.

Preferably, the suspension means is located on such a wing, which is firmly attached or mounted to an end of the anchoring rod. If an anchoring rod connected thereto is suspended on a wall formwork, in particular a closing formwork, in such a way that it extends in the vertical direction, then the center of gravity of the part of the anchoring system is located in the maximally possible manner below the suspension means. The position of the anchoring rod is stabilized in an additionally improved manner in the state of being suspended in this way.

In one embodiment, the suspension means is attached in the suspended state to the underside of a wing of the part of the anchoring system to be suspended, so that the wing is able to rest on the supporting element of a wall formwork. Thus, the position of the suspended part of the anchoring system comprising, in particular, the anchor and the locking device in addition to at least one laterally protruding wing is stabilized in an additionally improved manner. If the suspension means is attached to the underside of the wing, the suspensions means, viewed from the wing, extends in the direction of the other end of the anchoring rod, i.e. in the direction of the end that is pushed through anchoring rod bores of the closing formwork and the holding formwork for assembly.

In order to stabilize the position in an additionally improved manner, the underside of the wing with the suspension means attached thereto preferably has a plane surface, which is able to rest on a wall of a supporting element in the suspended state.

In one embodiment, a region of the suspension means, which leads away from one side of the wing, preferably, in the suspended state, in a downward direction from the underside of the wing, has a cross section corresponding to the cross section of the hole on which the suspension means is to be suspended. This region protrudes from the wing, i.e. preferably perpendicularly and/or in a downward direction towards the opposite end of the anchoring rod. This region of the suspension means, which preferably leads away in the downward direction, is adjacent to the edge region of the hole of a supporting element of a wall formwork and fills the predominant part of the hole when the pulled-out part of the anchoring system has been suspended. Thus, the position of the suspended part of the anchoring system is stabilized in an additionally improved manner. In particular, it is possible by means of this embodiment to prevent an anchoring rod from being pivoted to a great extent relative to the wall formwork in a troublesome manner when the associated wall formwork is tilted from an erected position towards a horizontal position. Such a pivoting would be accompanied in a disadvantageous manner by, inter alia, an increased accident hazard.

If a hole in a supporting element provided for suspension has a circular cross section, then the part or region of the suspension means leading away from a wing of the locking device is preferably also circular. If a hole in a supporting element provided for suspension has a rectangular cross section, then the region of the suspension means leading away from a wing of the locking device is preferably also rectangular. The diameter of this region of the suspension means then approaches the diameter of the hole in the suspended state in such a way that, on the one hand, a suspension is possible and, on the other hand, a pivoting, particularly when tilting an erected wall formwork, is largely avoided in order thus to at least minimize an accident hazard. Generally, the part of the suspension means adjacent to the edge of a hole in the suspended state is adapted to the geometry of the hole in such a way that a pivoting of the anchoring rod relative to the wall formwork is thus minimized.

In one embodiment of the invention, a region of the suspension means protruding from a wing, i.e., as a rule, a part of the suspension means that protrudes perpendicularly from the wing, has another portion that perpendicularly, or at least substantially perpendicularly, protrudes from the region at the protruding end. This protruding portion comes into a hollow profile of a supporting element when the corresponding part of the anchoring system has been suspended. The reliability of the suspension means is thus additionally improved.

The protruding portion is preferably formed by a flat, plate-shaped member in order to, on the one hand, be capable of being brought into a hole of the supporting element with as little trouble as possible and, on the other hand, to advantageously allow it to rest flat against an inner face of a wall of the supporting element, whereby the position of a suspended part of an anchoring system can be stabilized in an additionally improved manner.

In one embodiment, the distance between the suspension means and the anchoring rod corresponds to the distance of a hole of a supporting element, into which the suspension means is supposed to be brought, from the rear wall of the associated profile or supporting element. Thus, the position of the suspended anchoring rod is stabilized in an additionally improved manner.

This embodiment, which comprises a locking device to which the part of the anchoring system that can be pulled out for dismantling can be attached, can be produced with very little technical effort. A bore in the corresponding locking device is sufficient. In this embodiment, the advantage can also be realized that the anchoring system is held ready to hand at a particularly suitable location for a subsequent assembly without having to exert any great technical effort. The bore not only makes it possible to attach the part of the anchoring system that can be pulled out to this locking device, and thus also to the rear side of a wall formwork, if this locking device is attached to the rear side. Furthermore, it is also possible to attach the part of the anchoring system that can be pulled out in such a way that it is held in a stable manner, which serves work safety.

In an advantageous embodiment, the bore or a different attachment means is, in particular, disposed or configured in such a way that the anchoring rod, in the erected state of the wall formwork, extends perpendicularly or at least substantially perpendicularly when the anchoring rod has been inserted into the bore or is attached to the locking device by means of a different attachment means and the locking device is attached to the rear side of the wall formwork. In this embodiment, the part of the anchoring system that can be pulled out is attached to the locking device, and thus to the rear of a wall formwork, in a particularly reliable and simple manner when the locking device is attached to the rear side of the wall formwork.

In one embodiment of the invention, the bore is configured in such a way that the end of the anchoring rod that is pushed through the bore during dismantling can set down on a bar of the wall formwork. The reliable purchase on the locking device of the part of the anchoring system that is supposed to be pulled out for dismantling is thus additionally improved. The one end that is to be pushed through does not protrude over the wall formwork, which is advantageous with respect to work safety. In this embodiment, a bore is not necessarily provided in order to have the end of the anchoring rod set down advantageously on a bar of the wall formwork in order thus to stabilize the part of the anchoring system that can be pulled out.

In one embodiment of the invention, the bore or a different attachment means is configured in such a way that the anchoring rod includes an acute angle with the rear side of the wall formwork when the anchoring rod has been attached to the locking device. The part of the anchoring system that must be grasped for pulling out the part of the anchoring system that can be pulled out is in that case ready to hand in a particularly simple manner.

Each locking device of the anchoring system can preferably be disengaged from the anchoring rod and attached in different position to one end, respectively, of the anchoring rod, e.g. by means of screwing, in order to optimize effective lengths of the anchoring rod. Preferably, each locking device has an attachment member for attaching the locking device to a wall formwork. In particular, the attachment member includes a screw with which a locking device can be screwed to a supporting element of a wall formwork.

Basically, at least one, preferably both, locking devices comprise an underside that is plane at least in some portions and is provided, in particular, by a dome plate, which rests flat against the wall formwork or a supporting element of the wall formwork in the assembled state. A threaded portion, which can be screwed to an anchoring rod end, is connected to the dome plate, preferably in a movable manner. The threaded portion can be moved relative to the dome plate, preferably in a manner similar to a joystick.

In one embodiment of the invention, the threaded portion of the locking device is non-rotatably attached to the dome plate. By this embodiment, it is accomplished that an end of an anchoring rod pushed into wall formworks can be rotated into the threaded portion without the threaded portion co-rotating in an undesired manner. This, in particular, is a locking device that is to be mounted in advance, i.e. attached, to the rear side of a wall formwork, in particular the holding formwork, in order to then connect, in particular to screw, to this locking device an end of the anchoring rod pushed through the closing and the holding formwork.

A supporting element of a wall formwork basically consists of a metallic hollow profile, in particular a profile with a rectangular, square or hat-shaped cross section. Walls of such a profile are provided with one or more anchoring rod bores for pushing through an anchoring rod that also lead through the formwork facing of the wall formwork.

Preferably, the locking device is attached to a supporting element which, in the erected state, extends vertically in order thus to be able to anchor, in particular, along the entire height of a holding formwork at a particularly suitable location.

Preferably, a locking device is attached at the beginning of an assembly to the rear side of a holding formwork, because this maximizes the speed of an assembly. After the closing formwork has been erected, a technician is located on the side of the closing formwork. He will then be able to install anchoring rods immediately, which have been suspended on the rear side of the closing formwork subsequent to a previous dismantling process and are thus ready to hand.

In order to simplify and accelerate an assembly, the anchoring rod comprises, on the end that is not pulled out through the wall formwork for assembly, a graduation for producing walls of different thicknesses. By assembling the anchoring systems in accordance with the graduation, it is possible in a simple and exact manner to set a wall thickness provided in accordance with the graduation. Providing a graduation in an anchoring system constitutes an independent invention which, independent of providing a suspension means, is able to accelerate and simplify assembly.

In this invention, the anchoring rod is first pushed through anchoring rod bores of the closing and holding formwork, and the pushed-through end is connected, in particular screwed, to a locking device. This locking device is preferably firmly mounted to the rear side of the corresponding wall formwork, for example screwed to a longitudinal beam of this wall formwork. Preferably, this wall formwork is a holding formwork in order thus to be able to carry out an assembly particularly quickly. The anchoring rod is connected, for example screwed, to the locking device at a predetermined position. In order to find the predetermined position quickly and simply, there is preferably a stop. If the pushed-through end of the anchoring rod reaches the stop, the predetermined position has been reached. In the case of a screw connection, the stop prevents further insertion by screwing. In this embodiment, the anchoring rod is thus screwed into the threaded portion of the locking device in the maximally possible manner.

Subsequent thereto, the end of the anchoring rod that has not been pushed through is connected, on the opposite side, with the attachment member provided here, in such a way that this connection is aligned with the selected graduation. The wall with the desired thickness can be poured once both locking devices contact the respective rear wall, i.e. basically the rear wall of a supporting element. If the locking devices are firmly mounted to the respective wall formwork, then they contact the rear side of the respective wall formwork.

In one embodiment, the locking device that is connected to the end of the anchoring rod has a sleeve or a bore through which the anchoring rod can be pushed for assembly without having to screw. With its end, which is provided for this purpose, the anchoring rod can thus be pushed through the two wall formworks particularly quickly for assembly.

In one embodiment, the sleeve comprises an outer thread that is screw-connected with a securing nut in order to connect to the sleeve the end of the anchoring rod that is not pushed through the wall formworks. In turn, the sleeve is indirectly or directly preferably connected to the rear side of the corresponding wall formwork. Preferably, the sleeve is connected to the dome plate in such a way that the sleeve can be moved like a joystick relative to the dome plate in order thus to be able to align the sleeve for a trouble-free guidance of the anchoring rod. In that case, the dome plate is preferably attached to the rear side of the corresponding wall formwork, generally to the rear side of a closing formwork, and preferably by means of a screw connection in order to be able to carry out an assembly quickly, easily and reliably.

In one embodiment, the locking device comprises an adjusting member, preferably an adjusting nut, which is screwed onto the end of the anchoring rod that has not been pushed through. The adjusting member is set in accordance with the graduation, preferably by screwing the adjusting nut up to the intended graduation. Particularly preferably, there is a stop wedge that can be positioned in accordance with the graduation. The adjusting nut is then screwed towards the stop wedge until the stop wedge prevents further screwing. The anchoring rod is then pushed through the closing formwork and the holding formwork and connected to the locking device on the corresponding rear wall formwork. As a matter of principle, the rear formwork is the holding formwork. Now, the securing nut, which is suitably connected to the adjusting nut, is screwed onto the outer thread of the sleeve, preferably in the maximally possible manner. Thus, the corresponding wall formwork, which is preferably a closing formwork, is aligned exactly.

Preferably, the securing nut has wings in order to be able to quickly screw-connect the securing nut at least initially. If required, the securing nut is finally screw-connected by means of tools.

In one embodiment of the invention, grooves in the anchoring rod serve as the graduation. In this embodiment, in particular, the stop wedge can be positioned quickly and reliably in accordance with the graduation by a wall portion of the stop wedge reaching into a corresponding groove in the aligned state. In that case, the stop wedge is held in its intended position in such a way that it is capable of serving as a stop for an adjusting member.

Preferably, the stop wedge has an opening with a region that permits a quick displacement along the anchoring rod until a desired graduation position has been reached. Preferably, there is another region that tapers towards one end in order thus to be able to suspend the stop wedge in a furrow or groove of the graduation in a stable manner.

In order for the adjusting member or the adjusting nut and the securing nut to be able to be connected to each other in a particularly well-suited manner, both components comprise flanges that serve as stops with respect to each other. If the securing nut is screwed onto the sleeve with the outer thread, the flange of the securing nut is moved against the flange of the adjusting member. When the two flanges finally contact each other, a further tightening of the screw of the securing nut causes the associated wall formwork to be aligned.

In one embodiment, the graduation has markings that reflect the thickness of walls. The markings are provided, in particular, in the form of indications of numbers that correspond to the associated wall thicknesses. In one embodiment, for example, grooves of the graduation are provided with such markings.

For stability reasons, the anchoring system basically consists of metal, or at least very predominantly of metal.

Advantageous embodiments of the invention are explained in more detail below.

FIG. 1 shows a section of the rear side of a closing formwork with a longitudinal beam 1 and crossbars 2 attached to the rear side of a formwork facing 3. An anchoring rod 4 is pushed into an anchoring rod bore and attached to the longitudinal beam 1 by means of a locking device. The locking device comprises a dome plate 5 to which a sleeve 6 with an outer thread is attached in such a way that the sleeve 6 can be moved in a joystick-like manner relative to the dome plate 5 in order thus to be able to align the sleeve 6 for the anchoring rod 4 in a suitable manner if required. The dome plate 5 is screwed to the longitudinal beam 1 by means of a screw 7. A double-wing nut 8 is screwed on at the end of the anchoring rod 4. The position of the double-wing nut 8 is fixated by a grooved pin 9 that leads into the anchoring rod 4 laterally from a bore of the nut 8 and is held frictionally by means of a press-fit. The double-wing nut makes it easier to screw the pushed-through end of the anchoring rod into a threaded portion of the locking device provided on the side of the holding formwork.

A suspension means 10 disposed adjacent to the double-wing nut 8 is connected to the anchoring rod 4. The two hook-shaped ends 11 of the suspension means 10 can be threaded into upper holes 12 in crossbars in order thus to be able to suspend the anchoring rod together with the locking device, which is visible in FIG. 1, and the double-wing nut 8 after dismantling, primarily ready to hand adjacent to the anchoring rod bore through which the anchoring rod 4 has been pushed.

The locking device comprises an adjusting nut 13, a, for example triple-winged, securing nut 14 with an inner thread that can be screwed onto the outer thread of the sleeve 6. The position of the adjusting nut at a suitable location on the anchoring rod can be fixated by means of a cotter pin 15. The anchoring rod comprises a plurality of bores through which the cotter pin 15 can be pushed. The bores form a graduation in order to be able to simply and quickly align wall formworks for typical wall thicknesses.

Figure 2:
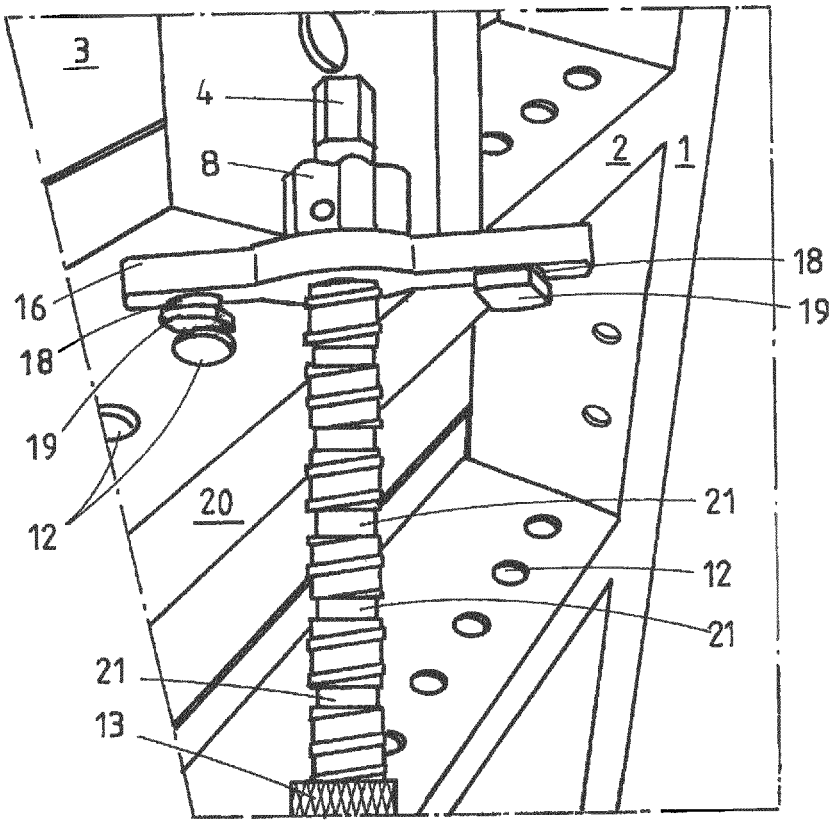
Figure 3:
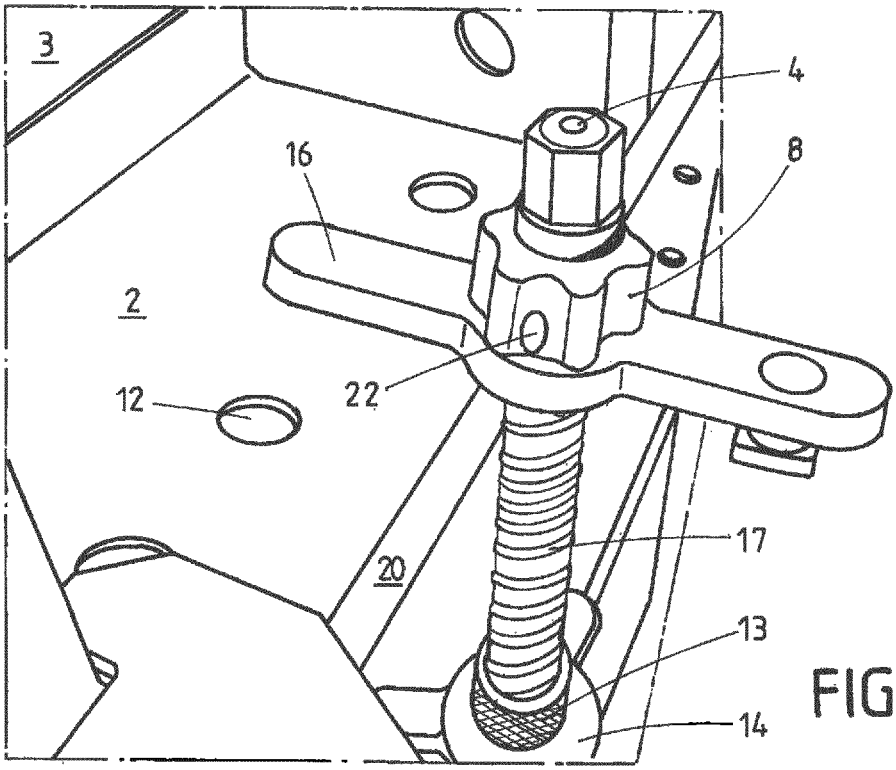
Figure 4:
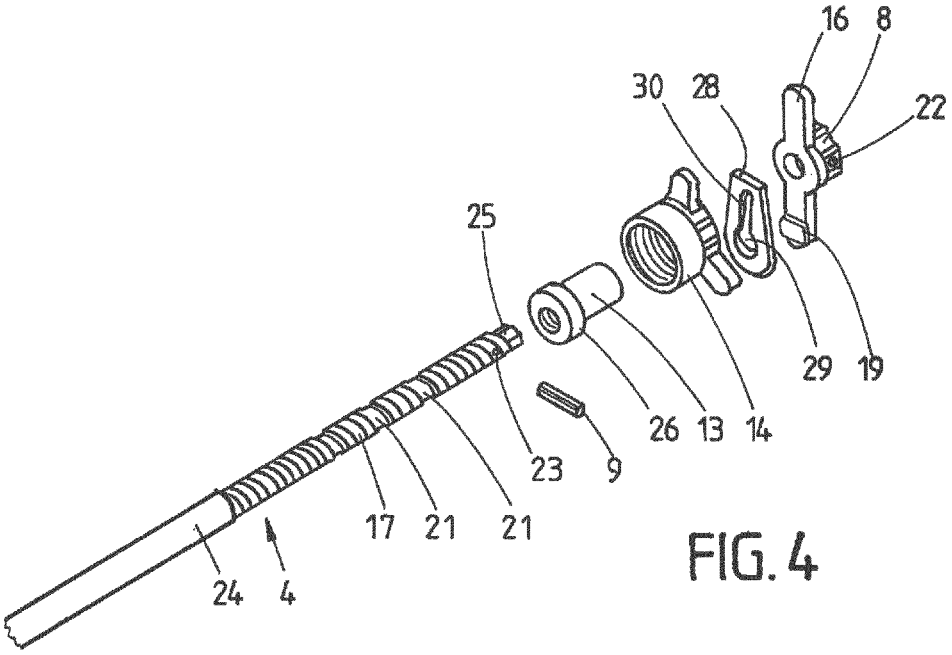

A particularly preferred embodiment is shown in the FIGS. 2, 3 and 4.

Using a wing 16 that protrudes perpendicularly from the end of the anchoring rod, a part of the anchoring system that was previously pulled out of the wall formwork can be suspended on a hole 12 of a crossbar 2, as the FIGS. 2 and 3 illustrate. Such a protruding wing 16 is preferably a part of the double-wing wing nut 8 that has been screwed onto the end of the threaded portion 17 of the anchoring rod 4. Each wing 16 has a suspension means with a first downwardly protruding region 18 with a circular diameter. At the lower end of the downwardly protruding region 18 of the suspension means, there is a plate-shaped, flat portion 19 of the suspension means which protrudes laterally from the wing 16 and perpendicularly from the region 18 with the circular diameter. Such a suspension means with the region 18 and the portion 19 can, as FIGS. 2 and 3 also show, be brought into a hole 12 of a side wall, which is accessible from the top, of a horizontally extending crossbar 2 in order thus to suspend the corresponding part of the anchoring system on the rear side of a closing formwork in the desired position in a reliable and stable manner. The region 18 with the circular cross section is adapted to the cross section of a hole 12 and fills it by more than 50% in the suspended state. The underside of each wing 16 is plane so that it is able, as is shown in FIG. 3, to rest flat on a side wall of a crossbar 2. The distance between the anchoring rod 4 with the threaded portion 17 and the suspension means with the region 18 corresponds to the distance of a hole 12 from the rear side 20 of the crossbar 2, so that an anchoring rod 4 with the thread 17 is adjacent to or rests on the crossbar 2 in the suspended state, which stabilizes the position of the suspended anchoring rod 4. As a whole, the part of the anchoring system that is being suspended is held in a stable position on the rear side of a closing formwork. Pivoting movements relative to the closing formwork are thus advantageously minimized.

The wings of the wing nut 8 can be used for manually twisting an anchoring rod at least initially. If the force required therefor increases too much, the head of the wing nut 8 can be twisted using tools.

The threaded portion 17 of the anchoring rod 4 is interrupted at regular intervals by a peripherally extending groove in order to be able to hook in a stop wedge here.

FIGS. 2 and 3 show a hole 22 in the nut 8 into which a grooved pin 9 is driven. FIG. 4 shows a bore 23 in the anchoring rod 4 in which the driven-in grooved pin 9 ends up for fixation. The anchoring rod 4, which is shown in some portions in FIG. 4, comprises a smooth middle region 24 that is allowed to end up in the concrete of a concrete wall to be produced. The end 25 of the anchoring rod adjacent to the threaded portion 21 is advantageously configured in a multi-edged manner in order to be able to twist it additionally, if required, using tools, such as, for example, a spanner.

On one end, the adjusting nut comprises a peripherally protruding flange 26 that serves as a stop for an inwardly directed flange 27 (see FIG. 1). The adjusting nut 13 comprises an inner thread that can be screwed onto the threaded portion 17 of the anchoring rod 4. A stop wedge 28 has a recess with a round region 29 and an elongate further region 30 connected thereto, which tapers towards the end. The threaded portion 17 can be threaded into the round region. The elongate region can be suspended in the grooves 21. The grooves 21 form a graduation in order to be able to make the alignment of wall formworks for typical wall thicknesses quick and easy. In that case, the stop wedge 28 is secured against displacement along the anchoring rod 4.

FIG. 4 shows the components of an anchoring system that are pulled out for dismantling and suspended. In that case, it is generally not necessary, advantageously, to disengage connections between dome plates and wall formworks.

Figure 5:
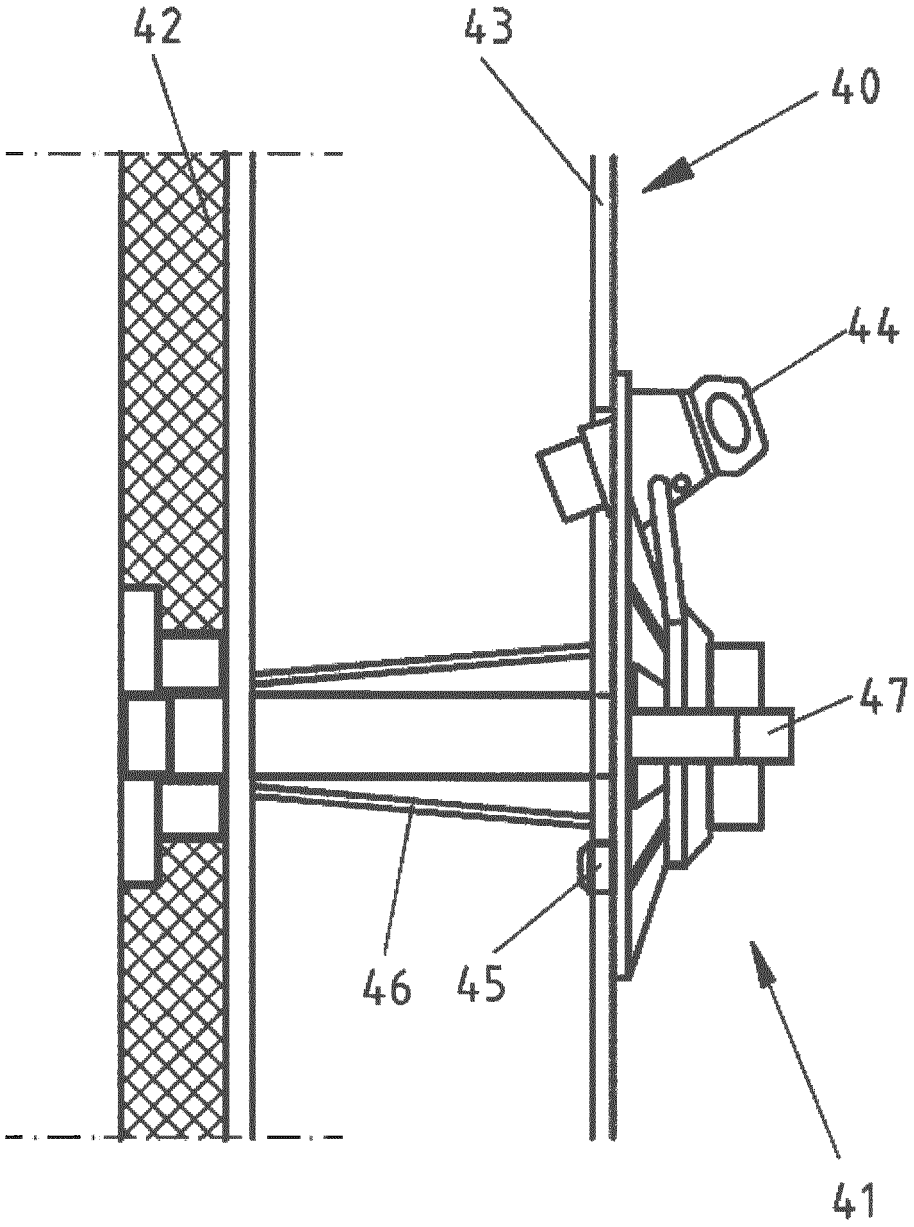

FIG. 5 shows a section of a holding formwork 40 with a locking device 41 attached thereto. On the front side, the holding formwork 40 has a formwork facing 42. The locking device 41 is attached to a longitudinal beam 43 by means of a screw 44 and a bolt 45 that suitably engage holes in the longitudinal beam. The screw 44 is positioned obliquely in such a manner that no threaded portion in the corresponding hole of the longitudinal beam 43 is required for attaching the locking device 41 to the longitudinal beam 43. For connection with an anchoring rod, the locking device 41 is suitably disposed above an anchoring rod bore 46 through which the end 48 of an anchoring rod 4 is pushed for assembly. After the end 48 of an anchoring rod 4 has been pushed through the bore 46, that end 48 is then connected, generally by a screw connection, to the locking device 41.

Figure 6:
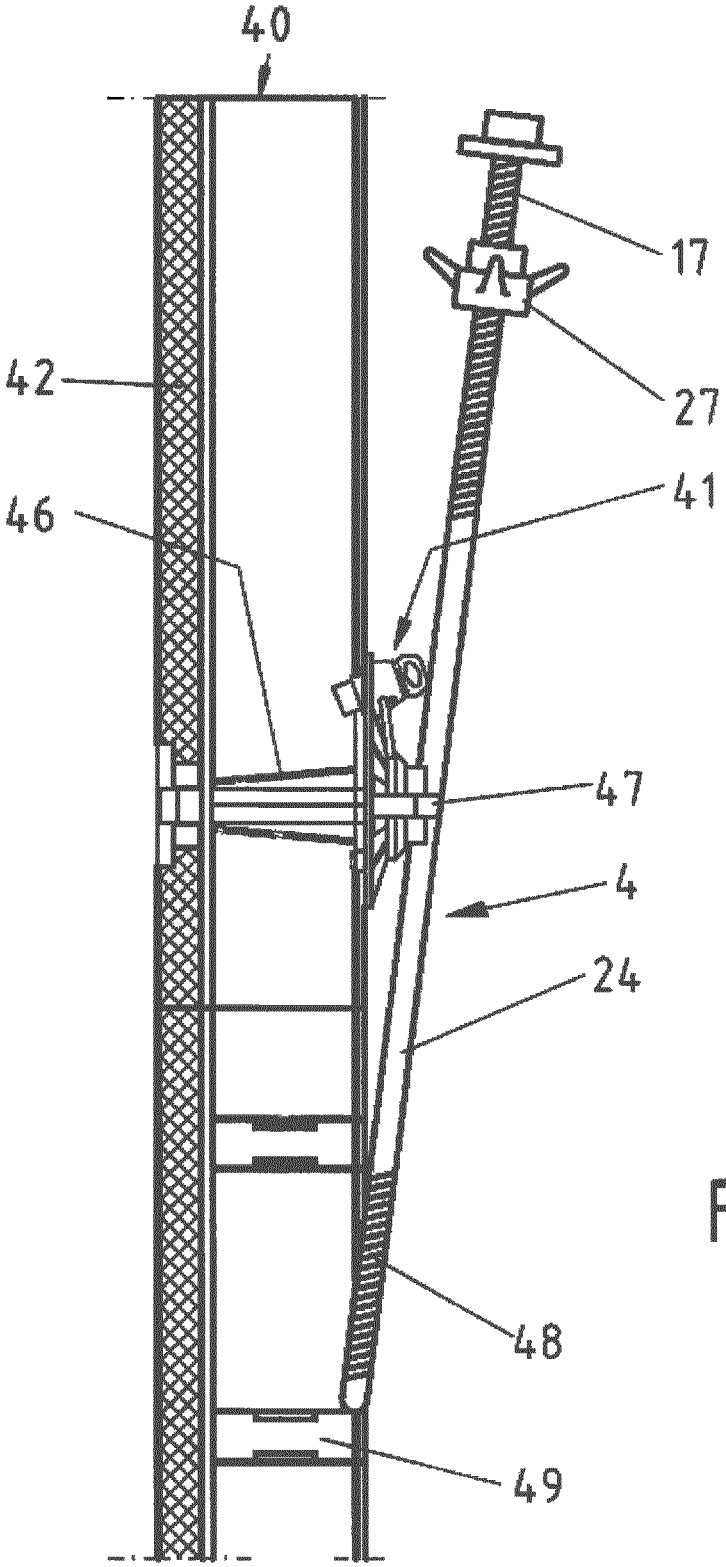

The locking device has a region 47 through which a bore leads vertically or at least substantially vertically and which is therefore not visible in the FIGS. 5 and 6.

FIG. 6 illustrates that a bore in the corresponding locking device 41 is sufficient in order to realize the advantage that the anchoring system with the anchoring rod 4 can be held ready to hand at a particularly suitable location for an assembly without having to exert any great technical effort. The bore in the region 47 not only makes it possible to attach the part 4, 27 of the anchoring system that can be pulled out to this locking device 41, and thus also to the rear side of the holding formwork 40, if this locking device 41, as shown in FIGS. 5 and 6, is attached to the rear side of a longitudinal beam 43. Furthermore, it is possible to attach the part 4, 27 of the anchoring system that can be pulled out in such a way that, as is shown in FIG. 6, it is held in a stable manner.

The bore is disposed and configured in such a way that the anchoring rod 4 extends substantially vertically in the depicted erected state of the holding formwork 40 when the anchoring rod 4, as is shown in FIG. 6, has been inserted into the bore and the locking device 41 is attached to the rear side of the holding formwork 40.

Furthermore, the bore is configured in such a way that the end 48 of the anchoring rod 4 that is pushed through the bore during dismantling, for example, sets down on a crossbar 49 of the wall formwork 40. As is shown, the end 48 that has been pushed through does not protrude over the rear side the wall formwork 40.

The bore is configured in such a way that, as shown, the anchoring rod 4 includes an acute angle with the rear side of the wall formwork 40 when the anchoring rod 4 has been attached to the locking device 41. The part of the anchoring system that must be grasped for pulling out the part 4, 27 of the anchoring system that can be pulled out is in that case ready to hand in a particularly simple manner.

The invention claimed is:

1. A method for dismantling a wall formwork from a concrete wall, the wall formwork including a holding formwork, a closing formwork and an anchoring system, the anchoring system including an anchoring rod and a locking device attached to one of the holding and closing formworks and that can be secured to the anchoring rod for holding the closing formwork to the holding formwork, the closing formwork and holding formwork defining therebetween a space into which concrete can be poured and hardened to form the concrete wall, and through which space the anchoring rod extends in a first direction, the locking device being engageable with the anchoring rod to prevent removal of the anchoring rod from the wall formwork in a first direction and disengageable from the anchoring rod to permit removal of the anchoring rod from the wall in a direction opposite the first direction, the locking device having associated therewith a stop member movable transversely to the first direction between a first position securing the stop member to the anchoring rod and a second position allowing the stop member to move along the anchoring rod, and the locking device having a hole extending transversely to the first direction and configured to receive the anchoring rod after the anchoring rod has been removed from concrete wall and to hold the anchoring rod to said one of the holding and closing formworks, the method comprising:

moving the stop member transversely to the first direction from the first position to the second position to allow the anchoring rod to move relative to the stop member for allowing the anchoring rod to be pulled out of the concrete and the holding and closing formworks, pulling the anchoring rod out of the concrete and the holding and closing formworks, reorienting the pulled-out anchoring rod into side-by-side relationship with the wall formwork, and attaching the pulled-out anchoring rod to said one of the holding and closing formworks by receiving the anchoring rod in the hole of the locking device attached to said one of the holding and closing formworks, such that the anchoring rod will be carried with said one of the holding and closing formworks after the holding and closing formworks have been disassembled with respect to one another.

2. An anchoring system for a wall formwork used to form a concrete wall, the anchoring system comprising:

an anchoring rod for holding together a holding formwork and a closing formwork of the wall formwork, which holding formwork and closing formwork form therebetween a space into which concrete can be poured and hardened to form the concrete wall, and the anchoring rod being configured such that it can be removed from the concrete wall and wall formwork after hardening of the concrete wall, and at least one disengageable locking device configured for attachment to one of the holding and closing formworks of the wall formwork, the locking device being engageable with the anchoring rod to prevent removal of the anchoring rod from the wall formwork in a first direction and disengageable from the anchoring rod to permit removal of the anchoring rod from the wall formwork in a direction opposite the first direction, wherein the locking device has a hole extending transversely to the first direction and configured to receive the anchoring rod after the anchoring rod has been removed from concrete wall and to hold the anchoring rod to said one of the holding and closing formworks, whereby the anchoring rod can be held adjacent said one of the holding and closing formworks and carried therewith after the holding and closing formworks have been disassembled with respect to one another; and wherein the locking device has associated therewith a stop member movable transversely to the first direction between a first position securing the stop member to the anchoring rod and a second position allowing the stop member to move along the anchoring rod.

3. The anchoring system according to claim 2, wherein a wing is attached to the anchoring rod and protrudes radially from the anchoring rod.

4. The anchoring system according to claim 2, comprising a graduation on the anchoring rod for use in producing walls of a desired thickness.

5. The anchoring system according to claim 4, wherein the graduation is formed by grooves or bores in the anchoring rod.

6. The anchoring system according to claim 2, further comprising at least one of a cotter pin, a stop wedge, a securing nut, an adjusting member and a sleeve with an outer thread.

7. The anchoring system according to claim 2, wherein an end of the anchoring rod is provided with a nut to facilitate rotation of the anchoring rod.

8. The method according to claim 1, further comprising removably attaching the locking device to said one of the holding and closing formworks.

* * * * *